United States Patent [19]

Lindblom

[11] Patent Number: 4,770,376

[45] Date of Patent: Sep. 13, 1988

[54] FASTENER DEVICE WHICH FUNCTIONS AS A ROCK DOWEL

[76] Inventor: Erik M. Lindblom, Skördevägen 88, 122 35 Enskede, Sweden

[21] Appl. No.: 27,657

[22] Filed: Mar. 19, 1987

[51] Int. Cl.[4] ..... A47G 29/00

[52] U.S. Cl. ..... 248/1 R; 248/216.1

[58] Field of Search ..... 248/1, 216.1; 411/453, 411/454, 478, 481, 499, 492, 447; 24/115 A

[56] References Cited

U.S. PATENT DOCUMENTS

| | | | |
|---|---|---|---|
| 570,633 | 11/1896 | Hatch | 411/447 |
| 1,375,633 | 4/1921 | Hamilton | 411/447 |
| 3,025,853 | 3/1962 | Mason | 411/478 X |
| 3,874,264 | 4/1975 | Polos | 411/913 X |

FOREIGN PATENT DOCUMENTS

| | | | |
|---|---|---|---|
| 55377 | 10/1938 | Denmark | 411/478 |
| 967270 | 3/1950 | France | 248/1 |
| 2263415 | 10/1975 | France | 248/1 |
| 2440206 | 7/1980 | France | 248/1 |
| 253276 | 11/1948 | Switzerland | 248/1 |

*Primary Examiner*—J. Franklin Foss

*Attorney, Agent, or Firm*—Burns, Doane, Swecker & Mathis

[57] ABSTRACT

A fastener device (1) which functions as a rock dowel and intended for use in rock climbing or for mooring boats, and the like, comprising a first element (2) and a second element (5) which are integrated with one another at a juncture (12). The first element (2) has the form of a wedge intended for co-action with a crack (3) in a rock surface or like surface, and the second element (5) forms an attachment for a line (8) or the like (7). The first element (2) is twisted in its longitudinal axis relative to a central plane (10) extending through the first element (2) from the juncture (12) at the second element (3).

23 Claims, 1 Drawing Sheet

FASTENER DEVICE WHICH FUNCTIONS AS A ROCK DOWEL

The present invention relates to a fastener that functions as a rock dowel, and more specifically to a fastener that can be used for rock climbing, mooring boats, and like purposes. The fastener of the present invention comprises a first and a second element which are integrated one with the other. The first element has the form of a wedge for insertion, for example, into a crack in rock face, and the second element forms an attachment for a rope, chain or like line.

BACKGROUND OF THE PRIOR ART

Fasteners are known to the art in various forms.

In one known embodiment of such a device, a first element has the form of a flat wedge intended for insertion into a crack in a rock face, or some other form of opening in some other surface.

This known fastening device, having the planar wedge-shaped first element, is planar and tapers in the direction of its longitudinal axis and in relation to a central plane passing through the first element adjacent the second element. The wedge-shaped first element also decreases in width towards its free end.

Devices of the aforesaid nature may either have plane-parallel side surfaces or have a small wedge angle. Experience has shown that the wedge angle should be smaller than 5°.

The wedge portion of these known fasteners is also relatively long in relation to its cross-section, normally ratios in this regard being from 5 to 15.

Fasteners of the aforesaid kind are known to the art in which the first element has a longitudinal extension in a first plane which is rotated somewhat in relation to a second plane passing centrally through the second element.

Various types of wedge-shaped implements are known, for example, for splitting logs, in which a wedge part has a form of a single member and the wedge tip or point is turned 10° in relation to a geometric central plane.

Such wedges have a large hammering or anvil surface at one end thereof and the wedge angle is quite large, for example larger than 10° but smaller than 15°. Such wedges are practically totally inelastic.

Consequently, driving wedges which are intended for splitting logs etc. are not suited for use in conjunction with fasteners for rock climbing or for mooring boats to rock surfaces.

With respect to prior art fasteners of the aforesaid kind, attachment of the device via the first element is effected exclusively through direct counter-directional clamping forces, in which a planar wedge surface is pressed against one wall of a crack, and the opposite planar wedge surface is pressed against the opposite wall of the crack. Any deformation which might occur is caused through the action of counter-directed forces acting on the same part or point on the wedge.

It has been found that in order to use such a wedge effectively the crack into which it is driven should have a width which more or less equals the maximum width of the wedge or which is slightly smaller than said width, and that the crack should be quite deep and preferably have a shape which conforms to the shape of the wedge.

Moreover, once driven into an ideal crack, the prior art fastener is extremely difficult to remove therefrom.

With reference to the state of the art beforedescribed it will be seen that one qualified technical problem resides in the provision of such fasteners that can be reliably secured in a crack whose width exceeds the maximum thickness of the wedge and/or whose configuration deviates from the configuration of the wedge.

Another technical problem resides in the provision of such a fastener with which the wedge-shaped element thereof can be subjected to torque such as to be brought into gripping co-action with mutually opposite walls of a crack, this torque causing diametriclly opposed wedge edges to grip against said crack walls.

Another technical problem resides in the provision of such a fastener so formed as to provide a reliable grip through the action of a large, substantially calculatable force, by observing material deformation caused by forces over and above the elastic deformation limit of the material and lying within the plastic deformation range.

With regard to the prior state of the art as described above, it is seen that a further qualified technical problem is one of providing a fastener of the kind intended for rock climbing, mooring boats to rock surfaces etc., with which the wedge-like first element of the device when inserted, for example, into a crack in a rock surface strives to engage the crack walls and to conform to the contours of the crack, such as to provide good contact between diametrically opposed and outwardly facing edge parts of the first element and the two engaging wall surfaces of the crack.

Still a further technical problem is one of providing such a fastener with which the diametrically opposed, outwardly facing edge parts of the first element coacting with opposite walls of a crack can be brought into positive and reliable engagement therewith and readily released therefrom in a simple manner.

Another technical problem is one of providing means whereby the aforesaid co-action between the wedge-like first element of the fasteners and the walls of a crack can be effected with the aid of torque or torsional forces acting in the material of the wedge-like element, between two outwardly facing and mutually opposite edge parts thereof, so that the wedge will grip firmly in the crack through the agency of such internal forces as those occurring with plastic deformation.

Another technical problem is one of providing such a fastener which, with the aid of simple means, can be made to conform more readily to the contours of a crack determines the size of the contact surface formed between the two mutually opposed and outwardly facing edge parts, when the pressure forces taken-up shall function as torque on the wedge.

OBJECTS AND SUMMARY

The present invention relates to a fastener which functions as a rock dowel and which can be used for rock climbing, mooring boats to rock surfaces, etc., which device includes a wedge-shaped first element for co-action with the walls of a crack in a rock surface, and a second element which is integrated with the first element and which forms an attachment for a rope, chain or the like.

In accordance with the present invention the first element is twisted in its longitudinal direction in relation to a center plane extending through said first element from a location adjacent the second element.

In one preferred embodiment of the invention the first element has a pointed end which can be turned to an angle of at least 30° in relation to the centre plane. According to a further development, this pointed end may be rotated through at most 360° in relation to said central plane. In this regard, the pointed end or tip of the first element may be given an angle relative to said central plane of between 45° and 180°, preferably between 60° and 120°.

The first element suitably comprises a material which when brought into gripping engagement with the walls of a crack is subjected at least partially to plastic deformation.

The wedge-like first element of the device may have a form such that it only decreases slightly in thickness towards its pointed end, and if desired, also slightly in width.

In accordance with one advantageous embodiment, the second element has a hardness which is greater than that of the first element.

Preferably only a part of the first element is twisted in relation to said central plane, the twist preferably being located at a location in the close vicinity of the second element.

The advantages primarily afforded by a fastener constructed in accordance with the present invention reside in the possibility of inserting the device into a crack in a rock surface, or like surface, and to obtain a firm and reliable grip therein even when the width of the crack exceeds the width of the fastener another advantage resides in the fact that the securing or fastening forces generated are substantially in the form of torque acting on said thereby to facilitate entry of the into the crack and reliable retention of the therein. In addition, the securing or gripping forces can be readily regulated to a desired level, and the device can be readily removed from the crack with the aid of simple means.

BRIEF DESCRIPTION OF THE DRAWING

Exemplifying and preferred embodiments of the present invention will now be described in detail with reference to the accompanying drawings, in which.

DETAILED DESCRIPTION

Figure 1:
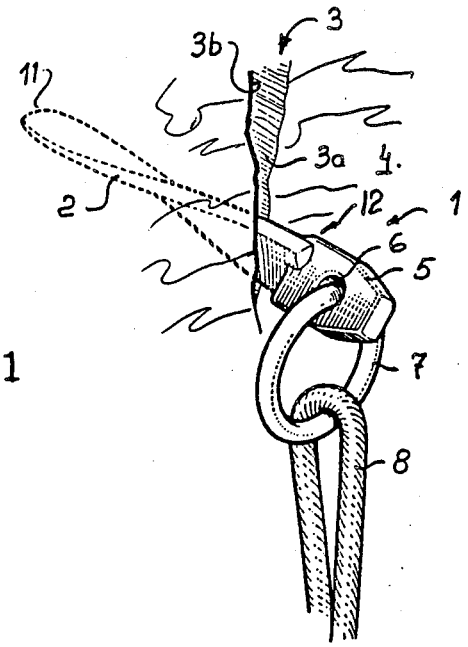
FIG. 1 is a perspective view of a fastner according to the present invention inserted in a crank in a rock surface.

In FIG. 1 there is illustrated in perspective a fastener device 1 which functions as a rock dowel for use in rock climbing, and which can also be driven into rock surfaces in waterside locations to facilitate the mooring of boats. The device 1 comprises a first element and a second element which is integrated with the first element. The first element 2, which has a wedge-like configuration, is intended to grip against the walls of a crack 3 in a rock surface 4 or like surface. The second element 5 forms an attachment means for a line, chain or the like. To this end, the second element 5 is provided with a hole 6 in which a ring 7 is held. Attached to the ring is a line 8, which may either be tied to a climber or to part of a watercraft, depending on the use to which the device 1 is put. When the device 1 is used to secure a boat to a rock at the water's edge for example, the line 8 can be caused to extend substantially horizontally.

The first element 2 need not be constructed to exert a wedge-action along the whole of its length.

Suitably, the wedge form of the first element 2 only extends a short distance from the tip 11 of said element towards the second element 5, with the remainder of the first element having a more or less right-angled constant cross-section therealong.

Irrespective of the configuration or form of the first element 2, the wedge-angle from the region 12, adjacent the second element 5, to the tip or point 11 should be less than 5°, preferably between 3° and 4°.

A device in which the wedge form of the first element 2 extends along roughly 25% of the total length of said element, with the remainder of the element having a constant crosssection, has been found particularly suitable.

The first element 2 may suitably be made of a material which, with a cross-sectional size of 6×18 mm and a length of 25 mm, will result in plastic deformation of the element at a torque of 120 Nm. In this respect, variations between 80 and 200 Nm can be accepted.

Figure 2:
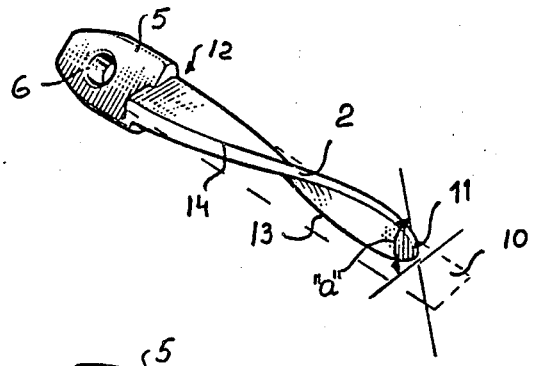
FIG. 2 is a perspective view of the device shown in FIG. 1, and illustrates the twist in the first element.

As shown in the FIG. 2, the first element 2 is twisted along its length in relation to a central plane 10 extending along the first element from the juncture 12 of its connection with the second element 5, so that one part of the first element is rotated relative to an adjacent part.

The ring 7 and line 8 have been omitted from FIG. 2 for the sake of clarity.

Thus, in the illustrated embodiments, the top or point 11 of the first element 2 is rotated through an angle "a", in relation to the central plane 10, of at least 30°. It will be understood that the tip 11 may be rotated relative to plane 10 through any angle, up to 360°. Preferably the angle "a" lies between 45° and 180°, and then most suitably between 60° and 120°. In the FIG. 2 embodiment, the tip 11 has been rotated through 90° in relation to the central plane 10.

The first element 2 is preferably made from a material such that when brought into gripping action with the mutually facing wall portions 3*a* and 3*b* of the crack 3, the element can be subjected to plastic deformation, such that subsequent to driving the first element 2 into the crack 3 (hammering the device), the element will be permanently deformed when removing the device from the crack 3. It is especially proposed that the device is driven into the crack 3 with such force and in such a manner that the element 2 does in fact become deformed plastically, since such plastic deformation signifies that the material in the first element 2 is used to a maximum in creating those torsional forces which shall hold the first element 2 firmly in the crack 3.

It is sufficient if this plastic deformation is only manifested along given sections of the first element 2.

The gripping forces exerted by the first element 2 on the crack walls 3*a* and 3*b* act through the diametrically opposed edges 13 and 14, in combination with the fact that one edge 13 or 14 forms an engagement point or edge surfaces against a respective wall-portion of the crack.

As will be seen from FIG. 2, the first element 2 of the preferably has a thickness which narrows only slightly towards the tip or point 11 of said element.

Figure 3:
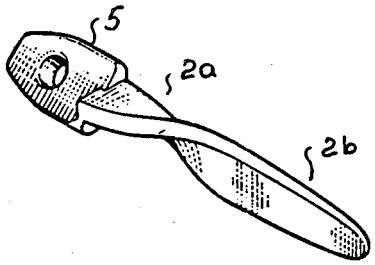
FIG. 3 is a view of an alternative embodiment.

The first element 2 may also be shaped so as to present a width which decreases, albeit but slightly, towards said tip or point 11, as illustrated particularly in FIG. 3.

The second element 5 of the fastener device 1 may be given a hardness which is greater than the hardness of the first element 2, since the first element 2 may be capable of being plastically deformed. The second element 5 should be capable of withstanding the impact forces to which it is subjected when driving the first element 2 into the crack 3, and of withstanding the load on the line 8 without being deformed.

In the embodiment illustrated in FIG. 3, only a part of the first element 2 has been twisted, namely the part *2a*, and the remainder, *2b*, of said element is flat. In addition, the twisted part *2a* of the first element 2 of the FIG. 3 embodiment is located in the vicinity of the juncture of the first element 2 and the second element 5.

With a fastener device constructed in accordance with the present invention it is possible to ascertain visually, when the wedge-like first element 2 is driven or hammered into the crack 3, that the material in said element has been loaded to a point above the elastic limit of said material, therewith guaranteeing that a lowest permitted gripping force has truly been exceeded.

Since the gripping forces concentrate at the edges 13 and 14, a strong and secure grip is achieved when a load is applied in the direction of the line 8. When wishing to remove the wedge-like first element, it is simply pulled straight out of the crack.

The invention is not restricted to the described and illustrated embodiments, since modifications can be made within the scope of the following claims.

I claim:

1. A fastener for securing a line to a crack in a rock surface, comprising:

a longitudinally extending blade having a longitudinal axis, said blade being made from a deformable material;

a portion of the longitudinally extending blade being helically twisted along its longitudinal axis; and means attached to one end of the longitudinally extending blade for attaching the line to the longitudinally extending blade, wherein the means includes an opening to receive the line; and wherein the blade and attaching means are strong enough to support the weight of a person on the line when the blade is inserted in the crack of the rock surface.

2. The fastener of claim 1, wherein the width of the blade is at least one-third of the height of the blade.

3. The fastener of claim 1, wherein the attaching means has a hardness that is greater than the hardness of the blade.

4. The fastener of claim 1, wherein the attaching means includes a flat portion having a hole therein.

5. The fastener of claim 4, wherein the attaching means further includes a ring mounted in the hole.

6. The fastener of claim 1, wherein the longitudinally extending blade includes a planar portion.

7. The fastener of claim 1, wherein the attaching means extends in longitudinal alignment with the longitudinally extending blade.

8. The fastener of claim 1, wherein the portion of the longitudinally extending blade is twisted through an angle between 45° and 180°.

9. The fastener of claim 1, wherein the portion of the longitudinally extending blade is twisted through an angle between 60° and 120°.

10. The fastener of claim 1, wherein the portion of the longitudinally extending blade is twisted 90°.

11. The fastener of claim 1, wherein the blade is made from a plastically deformable material.

12. The fastener of claim 1, wherein the blade has a thickness that decreases toward the tip thereof.

13. The fastener of claim 1, wherein the blade has a width that decreases toward the tip thereof.

14. The fastener of claim 1, wherein the blade is wedge shaped.

15. A fastener for securing a line to a crack in a rock surface, comprising:

a longitudinally extending blade having a longitudinal axis;

a portion of the longitudinally extending blade being helically twisted along its longitudinal axis; and means attached to one end of the longitudinally extending blade for attaching the line to the longitudinally extending blade;

wherein the helically twisted portion of the longitudinally extending blade is adjacent the attaching means, and the remainder of the longitudinally extending blade is planar.

16. The fastener of claim 15, wherein the width of the blade is at least one-third of the height of the blade.

17. The fastener of claim 15, wherein the attaching means has a hardness that is greater than the hardness of the blade.

18. The fastener of claim 17, wherein the attaching means includes flat portion having a hole therein.

19. The fastener of claim 15, wherein the blade has a width that decreases toward the tip thereof.

20. The fastener of claim 15, wherein the portion of the longitudinally extending blade is twisted through an angle between 45° and 180°.

21. The fastener of claim 15, wherein the portion of the longitudinally extending blade is twisted through an angle between 60° and 120°.

22. The fastener of claim 15, wherein the blade has a thickness that decreases toward the tip thereof.

23. The fastener of claim 15, wherein the blade and attaching means are strong enough to support the weight of a person on the line when the blade is inserted in the crack of the rock surface.

* * * * *